US010702453B2

(12) United States Patent
Chang et al.

(10) Patent No.: US 10,702,453 B2
(45) Date of Patent: Jul. 7, 2020

(54) METHOD AND SYSTEM FOR PRINTING PERSONALIZED MEDICATION

(71) Applicant: Xerox Corporation, Norwalk, CT (US)

(72) Inventors: Shu Chang, Pittsford, NY (US); John L. Pawlak, Rochester, NY (US); Michael L. Grande, Palmyra, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/676,387

(22) Filed: Nov. 14, 2012

(65) Prior Publication Data

US 2014/0134320 A1 May 15, 2014

(51) Int. Cl.
*A61J 3/00* (2006.01)
*B41F 17/36* (2006.01)

(52) U.S. Cl.
CPC ..... *A61J 3/007* (2013.01); *A61J 3/005* (2013.01); *B41F 17/36* (2013.01)

(58) Field of Classification Search
CPC ..... A23G 3/54; G03G 15/08; A61J 3/007
USPC ..... 426/103; 399/266
See application file for complete search history.

(56) References Cited

U.S. PATENT DOCUMENTS 4,197,289 A 4/1980 Sturzenegger et al.
4,349,531 A 9/1982 Mlodozeniec et al.
5,699,649 A 12/1997 Abrams et al.
5,960,609 A 10/1999 Abrams et al.
5,965,161 A 10/1999 Oshlack et al.
6,074,688 A 6/2000 Pletcher et al.
6,208,825 B1 3/2001 Hays
6,327,452 B1 12/2001 Jaskowiak et al.
(Continued)

FOREIGN PATENT DOCUMENTS

JP 2001-346526 * 6/2000

OTHER PUBLICATIONS

"'Printing' pills to order: research to create safer, faster-acting medicines", ScienceDaily, May 24, 2010 (HTTP://www.sciencedaily.com/releases/2010/05/100524073001.htm ).
(Continued)

*Primary Examiner* — Dah-Wei D. Yuan
*Assistant Examiner* — Andrew J Bowman
(74) *Attorney, Agent, or Firm* — Fay Sharpe LLP

(57) ABSTRACT

An exemplary method of printing medications on digestible substrates is described. Single component nonmagnetic toners with active pharmaceutical ingredients (API) embedded or "dissolved" in the toner are used. The binders for the toner are digestible. The "printing" process includes loading the single component non-magnetic toners from a sump to a donor roll and developing them either directly onto the substrate or through the use of an intermediate member. Traditional xerographic charge and exposure can be used to make the tablet "imprints". Dosage is controlled through "solid area" or halftone development (when charge and exposure are used). The "printed" first layer may undergo cold or warm pressure fusing. This medicament layer is then subjected to another station to "print" a second layer of medical "tablet". Multiple stations may be used to build up a complete personalized tablet. Optionally, a final station prints protective overcoat materials to finalize the "tablet".

15 Claims, 3 Drawing Sheets

(56) References Cited

U.S. PATENT DOCUMENTS

| | | | | |
|---|---|---|---|---|
| 6,488,963 | B1 | 12/2002 | McGinity et al. | |
| 6,652,903 | B2 | 11/2003 | Muller | |
| 6,706,281 | B2 | 3/2004 | Oshlack et al. | |
| 6,802,313 | B2 | 10/2004 | Pletcher et al. | |
| 6,923,979 | B2 | 8/2005 | Fotland et al. | |
| 7,632,533 | B2 | 12/2009 | Fotland et al. | |
| 7,732,020 | B2 | 6/2010 | King et al. | |
| 2005/0063737 | A1 | 3/2005 | LeStrange et al. | |
| 2007/0122208 | A1 | 5/2007 | Hays | |
| 2008/0056776 | A1 | 3/2008 | Gross et al. | |
| 2008/0124135 | A1* | 5/2008 | Uetake | G03G 15/0813 399/266 |
| 2008/0305219 | A1* | 12/2008 | Stewart | A21D 13/0009 426/103 |
| 2008/0311191 | A1* | 12/2008 | Nangia | A61K 9/0065 424/457 |
| 2009/0284762 | A1 | 11/2009 | Zhang et al. | |
| 2010/0021189 | A1 | 1/2010 | Sheflin et al. | |
| 2010/0092200 | A1 | 4/2010 | Ramesh et al. | |
| 2010/0158572 | A1 | 6/2010 | Knapp | |
| 2010/0322645 | A1 | 12/2010 | Kurz | |
| 2011/0008077 | A1 | 1/2011 | Moore | |

OTHER PUBLICATIONS

Tadena, N., "America's most medicated state? West Virginia", MSNBC, (http://www.msnbc.msn.com/id/3872723/ns/health-forbescom/ ).
"Tablet", Wikipedia (http://en.Wikipedia.org/wiki/tablet).

* cited by examiner

METHOD AND SYSTEM FOR PRINTING PERSONALIZED MEDICATION

BACKGROUND

The embodiments disclosed herein relate to a method and system for printing personalized medication such as tablets.

By way of background, a tablet is a pharmaceutical dosage form. It typically comprises a mixture of active substances and excipients, usually in powder form, pressed or compacted from a powder into a solid dose. The excipients can include diluents, binders or granulating agents, glidants (flow aids) and lubricants to ensure efficient tableting; disintegrants to promote tablet break-up in the digestive tract; sweeteners or flavors to enhance taste; and pigments to make the tablets visually attractive. A polymer coating is often applied to make the tablet smoother and easier to swallow, to control the release rate of the active ingredient, to make it more resistant to the environment (extending its shelf life), or to enhance the tablet's appearance.

The compressed tablet is the most popular dosage form in use today. About two-thirds of all prescriptions are dispensed as solid dosage forms, and half of these are compressed tablets.

One of the biggest issues facing pharmacists is ensuring that patients understand what the medication is used for and how to take their medications correctly, i.e., the right drug, the right time, etc. It can be especially confusing for elderly and mentally challenged patients who are on, for example, as many as ten different drugs a day. Also, today's tablets are produced in discrete quantities of active pharmaceutical ingredients (API). A ninety pound person and a three hundred pound person may be prescribed the same quantity of medication. For composite medications such as a vitamin, everyone presumably takes the same dose regardless of the need.

Tablets are produced pretty much the same way whether in pounds or in tons, depending on their medical purposes and newness. There is also a demand for better methodologies in achieving more rapid prototyping and time-to-market.

The tablet fabrication process has not changed much in principle, except for advancements in technology and quality controls. Tablets are typically large, not for medical purposes, but for ease of handling. Tablets have many shapes and colors so that they can be distinguished. Tablets may be stamped with symbols, letters and/or numbers for ease of identification. Tablets may be designed for ease of swallowing with control agents added for releasing API through dissolution or disintegration in the digestive tract. Tablets generally start as dry powder or granules. The powders typically have particle sizes of 3-30 ums. Granule sizes are generally between 45-450 ums. Additives to tablet binders include, for example, API, excipients (pharmaceutically inactive ingredient), disintegrants, lubricants, and additives for flow. Typically 99.9% of the materials in a tablet are NOT API.

The manufacturing process of powders or granules for forming tablets is actually quite similar to toner manufacturing. There are two basic granulation techniques. Wet granulation is where a liquid binder is used to agglomerate the powder mixture. After the granules are dried, they are screened for size uniformity. In dry granulation, a powder is compacted by application of a square low pressure force and then it is broken up gently to produce granules. After granulation, the material is then blended with powder lubricants. In addition to granulation, hot melt extrusion is a modern technology used to produce powders for drugs. Output from the hot melt extrusion can be pellets or spheroids. The polymers used for the hot melt extrusion have glass transition temperatures between 90 to 150° C. The overall property of medicament powder is similar to xerographic toners (minus charge control agents).

Tablet diameter and shape are determined by the die used to produce them. The die generally has an upper and a lower punch. The tablet thickness is determined by the amount of material and the position of the punches in relation to each other during compression. The input materials to fill the die are granules. The compression of tablets is similar to pressure fusing of toner particles without external thermal heat source in principle.

Because of the "pressure fusing" manufacturing process, the resulting tablets generally have a range of porosity of between 5 and 20%. Tablets need to be hard enough so that they do not break in the bottle and resist the stresses of packaging, shipping and handling by pharmacists and patients; and yet still be friable enough to disintegrate in the gastric tract. Tablets may be coated to further ensure this requirement. Coatings also prevent tablets from sticking to each other, help to reduce unpleasant tastes, provide a smoother finish for ease of swallowing, extend the shelf life of components that are sensitive to moisture or oxidation, and protect light-sensitive components from photo degradation. The coatings are typically polymer and polysaccharide-based, with plasticizers and pigments.

There are at least two issues for patients: (1) managing and taking the pills and (2) taking the right amount. Many seriously ill and long-term patients take many pills a day, and it can be a struggle for some of them to consume some 10-15 pills at a time. For some elderly and mentally-challenged patients, in addition to taking many medications each day, it can be difficult for them to manage their pills. In the best case, all patients should take the quantity of medication that is the most suitable for them. Techniques that pharmacists currently use to help patients manage their medications include, for example, weekly pill boxes (someone lays out all the tablets by time of day), alarms (replace the cap from the pharmacy with a special computerized one that rings when the patient needs to take a dose of a medication), and text messaging.

In the United States, pharmacists generally repackage medications from a stock bottle (usually containing quantities of 100 tablets) into a smaller bottle that is labeled for a specific patient. In Europe, the pharmacists tend to use blister packs (also referred to as "unit dose" packaging).

Today, tablets are produced from pounds to tons in weight, depending on the need and the newness of the medication. There is also a need for rapid prototyping, shorter trial duration, faster FDA approval, and especially a desire to quickly bring new medications to seriously ill patients.

BRIEF DESCRIPTION

Described herein is an exemplary method of printing medications on digestible substrates or substrates that can be expelled from the digestive tract. The exemplary embodiment generally utilizes single component nonmagnetic toners with active pharmaceutical ingredients (API) embedded or "dissolved" in the toner. The binders for the toner are also digestible or can be excreted. During the "printing" process, single component, non-magnetic toners are loaded from a sump onto a donor roll whereby the toners develop either directly onto the substrate or through the usage of an intermediate member using biased development. Since high image resolution is not required, the developed area can be formed from a mask. Traditional xerographic charge and exposure techniques can also be used to make the tablet "imprints". Dosage can be controlled through "solid area" or halftone development (when charge and exposure are used). The "printed" first layer may optionally undergo fusing, which can be pressure fusing with minimal (less than and not significantly exceeding the glass transition temperature of the binder) or no heat, depending on requirements by the API. This medicament layer is sent to another station for "printing" a second layer of medical "tablet". Multiple stations may be used to build up a complete personalized tablet. A final station prints protective overcoat materials to finalize the "tablet". Optionally, each printed layer may undergo cold pressure fusing or warm pressure fusing.

In one embodiment, a method of printing personalized medication with a printing system is provided. The method includes: compounding an active pharmaceutical ingredient (API) in binder to create at least one triboelectrically chargeable medicament toner; transferring the charged toner to a selectively exposed intermediate member; transferring the toner from the intermediate member to an edible substrate; and fusing the transferred toner via cold pressure, warm pressure, or radiant fusing. Also, the intermediate member may comprise a donor roll or a web.

In another embodiment, a method of printing personalized medication with a printing system is provided. The method includes: compounding an active pharmaceutical ingredient (API) in binder to create at least one triboelectrically chargeable medicament toner; directly depositing the medicament toner onto an edible substrate; and fusing the transferred toner via cold pressure, warm pressure, or radiant fusing.

Optionally, with regard to either or both of the above-mentioned embodiments, one or more pharmaceutically inert ingredients may be compounded in the binder in addition to the API. The system can be either two-component (i.e., include a carrier) or single component. In some embodiments, the system uses single component, non-magnetic, API-containing toners. Further, some systems may include multiple transfer stations to deliver either increased doses or tablets with more than one API.

In yet another embodiment, a computer-implemented method of printing personalized medication is provided. The method includes loading a first single component, non-magnetic toner from a first sump onto a first donor roll, wherein the first single component, non-magnetic toner comprises a first active pharmaceutical ingredient (API) embedded or dissolved in the first toner; transferring the first single component, non-magnetic toner from the first donor roll to an edible substrate to form a first layer on the edible substrate; loading a second single component, non-magnetic toner from a second sump onto a second donor roll, wherein the second single component, non-magnetic toner comprises a second API embedded or dissolved in the second toner; transferring the second single component, non-magnetic toner from the second donor roll to the edible substrate to form a second layer on the edible substrate; developing the layers of toner; and depositing one or more protective overcoat materials over the layers of toner to finalize the medication.

In yet another embodiment, a system for printing personalized medication is provided. The system includes: a first sump that is configured to load a first single component, non-magnetic toner onto a first donor roll, wherein the first single component, non-magnetic toner comprises a first active pharmaceutical ingredient (API) embedded or dissolved in the first toner and the first donor roll is configured to transfer the first single component, non-magnetic toner to an edible substrate to form a first layer on the edible substrate; a second sump that is configured to load a second single component, non-magnetic toner onto a second donor roll, wherein the second single component, non-magnetic toner comprises a second active pharmaceutical ingredient (API) embedded or dissolved in the second toner and the second donor roll is configured to transfer the second single component, non-magnetic toner to an edible substrate to form a second layer on the edible substrate; a developer that is configured to develop the layers of toner; a fuser that is configured to fuse the transferred toner; and a depositor that is configured to deposit one or more protective overcoat materials on the layers of toner to finalize the medication.

DETAILED DESCRIPTION

Figure 1:
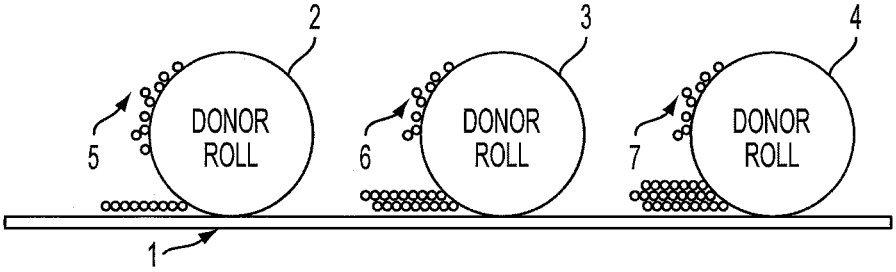
FIG. 1 shows multiple xerographic stations for depositing multiple medications on an edible substrate.

The exemplary embodiment relates to a method of "printing" personalized medications (or tablets) on digestible substrates or on substrates that can be excreted from the digestive tract. The exemplary embodiment generally involves the use of toners, which have active pharmaceutical ingredients (API) embedded or "dissolved" in toner binders. The binders are also either digestible or can be excreted.

More particularly, the exemplary embodiment generally includes compounding an active pharmaceutical ingredient (API) in binder to create at least one triboelectrically chargeable medicament toner. The medicament toner may be deposited to edible substrates through at least two ways: (1) by direct deposition onto edible substrates (as in Xerographically direct to paper) or (2) by developing the charged toner to a selectively exposed intermediate member and transferring the toner from the intermediate member to an edible substrate. The transferred toner may be fused via cold pressure, warm pressure, or radiant fusing. Optionally, one or more pharmaceutically inert ingredients are compounded in the binder in addition to the API. The system can be either two-component (i.e., include a carrier) or single component. In some embodiments, the system uses single component, non-magnetic, API-containing toners. Further, some systems may include multiple transfer stations to deliver either increased doses or tablets with more than one API. The exemplary embodiments will be described in greater detail below.

In single component development systems, the toner particles are usually triboelectrically charged and generally are required to jump a gap to develop the electrostatic latent image on an image surface. Most single component development systems cause the charged toner particles to be transported to a development zone where they are caused to form a toner cloud by the action of an AC electric field. A combination of AC and DC electrical biases attract the charged toner particles in the toner cloud to the electrostatic latent image on image surface, thereby developing the image and rendering it visible. There are several reasons for selecting single component, nonmagnetic toners. For example, single component development does not need a carrier. Also, single component development does not need highly charged particles, which gives more latitude to particle designs. Typical single component toners are charged by the metering blade on the donor roll before development and have a low Q/m ratio. In addition, single component development can use either Emulsion Aggregation (EA) or conventional toners. Moreover, single component development is a relatively "gentle" process.

There are various ways to deposit or "print" the medicament toners onto digestible substrates. For example, in one printing system, a donor roll is employed to load the single component non-magnetic toners from a sump whereby toners could be developed through electric bias directly onto the substrate. Alternatively, toners can be developed through electrical bias onto an intermediate member and then transferred onto the substrate.

FIG. 1 illustrates an example of multi-station fabrication of medical "tablets" using single component non-magnetic development that directly deposits the medicament powder onto an edible substrate 1. With reference to FIG. 1, multiple stations (2, 3, and 4) may be used to build up a complete personalized tablet on the edible substrate 1, with each station depositing a different medicine. Each toner (5, 6, 7) at each station has a different active pharmaceutical ingredient (API) dispersed in the binder. Although not shown, it is to be understood that a sump is used to hold toner, which includes at least one API, along with a mechanism for automatically replenishing toner, as it is consumed.

Figure 2:
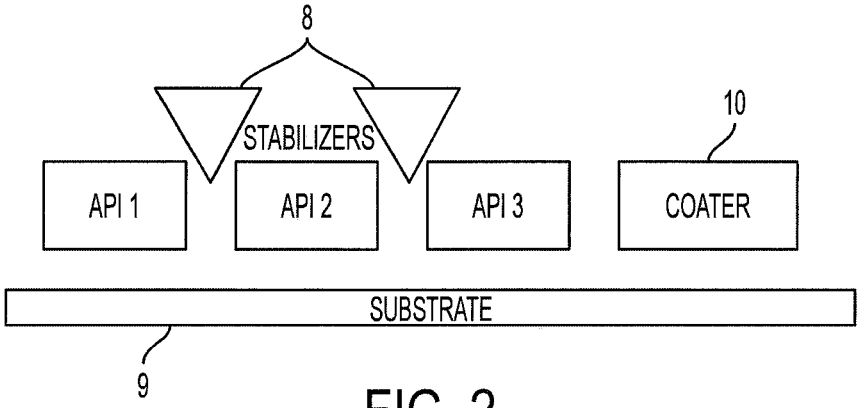
FIG. 2 is a block diagram showing stations inserted between two adjacent depositions for the use of stabilizing the previous "layer" before the next deposition.

FIG. 2 depicts some optional steps in the tablet-making process. That is, one or more stations 8 can be inserted between two adjacent depositions of API on the substrate 9, e.g., between API 1 and API 2 or between API 2 and API 3, etc., for the use of stabilizing the previous "layer" before the next deposition. To keep each medicament "layer" from contaminating the next deposition station 8, a fuser (or stabilizer such as charger) may be incorporated to compact or fuse the toner (this can be cold pressure, warm pressure, or conventional toner fusing). A final station 10 overprints the medication with protective materials for tablet coating.

Since high image resolution is not required, the medicament "tablet" shape can be formed from a mask (an insulation material with openings for toner development) or through traditional xerographic charge and exposure methods and systems. Medicament dosage can be controlled through layers of "solid area" in the mask development. In the case that a "real" latent image can be formed, dosage can also be controlled by using halftones.

The receiving substrate can be edible papers or any other suitable materials that will not disintegrate in the digestive tract and can be expelled (paper itself may qualify for this requirement). The receiving substrate generally needs to be at least similar to paper in physical properties to facilitate deposition and stabilization of the toner on the edible substrate.

There are various advantages to building a personalized medicament tablet through single component non-magnetic development. For example, such a process is likely to work with a high percentage of APIs used in the tablet form of medicines. Also, fabrication and characteristics of medicament powders are similar to "toner" and its manufacturing, in particular, is similar to the conventional toner manufacturing. Further, polymers used in current hot melt extrusion have similar glass transition temperatures as xerographic toners.

Suitable materials for binders include polyesters, which are used in hot extrusions of pharmaceutical excipients. Such polyesters have similar properties as xerographic toners. Polyesters tend to be charged negatively. If charge, or Q/M, of the particles need to be enhanced, use of charge control agents are possible. For example, salicylate-type materials (i.e., the medicine used in Aspirin) have the necessary properties to serve as a charge control agent. Besides charge control agents, it is also possible to use other means to enhance particle charges. For example, US patent publication 2008/0056776, the disclosure of which is incorporated herein by reference, shows an example of using corotron to pretreat the particles.

Preventing contamination of donor rolls is a consideration. Donor rolls for single component development are made of semi-conductive rubbers. They are typically polyurethane doped with ionically conductive salts. Polyurethane is chemically inert. Polyurethane is used as storage containers/foams for pharmaceutical solutions. When digested, it becomes urea (a component of animal urine). Contamination of polyurethane from donor roll wear to printed pills is very minimal. The overall effect of polyurethane on the medication is virtually none. Ionically conductive salts are also widely used in pharmaceutical industry. Any reactions between the salt leached out of the donor roll and the pharmaceutical ingredients can be minimized or eliminated, since the active pharmaceutical ingredients constitute only 0.5% of the total materials used in the tablet, which is buried in the binder or through the correct selection of the salts.

The term "marking engine" is used herein generally to refer to a device for applying an image to print media. Print media usually refers to a physical sheet of paper, plastic, or other suitable physical print media substrate for images, whether precut or web fed. In this case, the print media includes digestible substrates or substrates that can be excreted from the digestive tract. As used herein, a "printing system" can be a digital copier or printer, multi-function machine, or the like and can include one or more marking engines, as well as other processing components, such as print media feeders, finishers, and the like.

Figure 3:
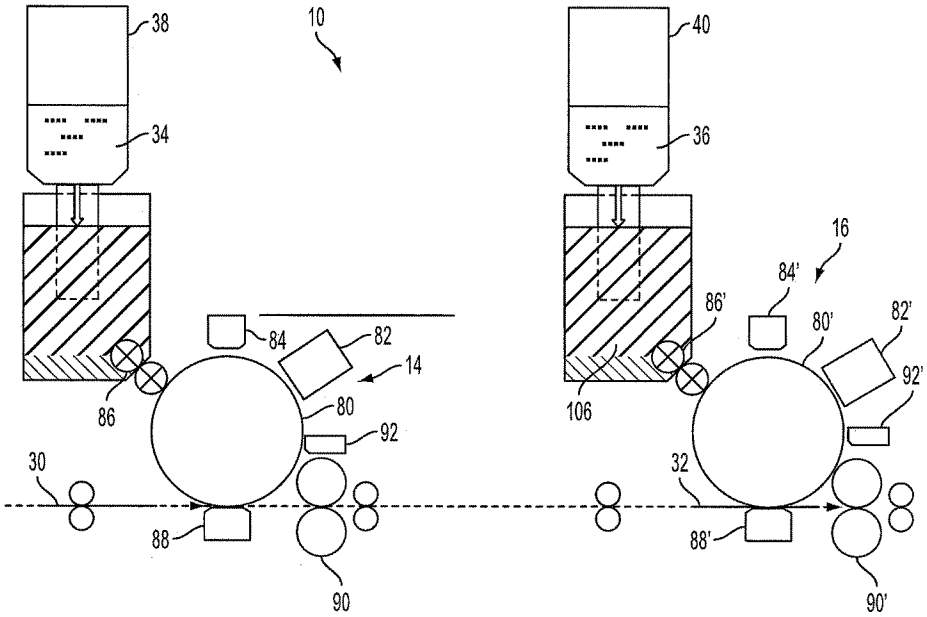
FIG. 3 is a block diagram of an exemplary printing system suitable for implementing aspects of the exemplary embodiment.

With reference to FIG. 3, an exemplary apparatus 10 for printing personalized medication, such as tablets, in accordance with the exemplary embodiment is schematically illustrated. Of course, it is to be understood that other types of printing systems may be utilized in accordance with aspects of the exemplary method. In this regard, reference is made to several U.S. patents and patent Publications that describe additional printing system architectures that may be suitable for implementing the exemplary embodiment, including U.S. Pat. No. 6,208,825, U.S. Patent Publication No. 2011/0008077, and U.S. Patent Publication No., 2010/0021189, the disclosures of which are incorporated herein by reference.

As shown in FIG. 3, the apparatus 10 may include first and second xerographic (electrostatic) marking engines 14, 16. It is to be appreciated, however, that the apparatus 10 may include any number of marking engines, depending on the application and the number of active pharmaceutical ingredients to be deposited in each tablet.

The developer generally includes only toner particles (or toner). The toner (or, in this case, API(s) and/or other materials) is consumed by the marking engines 14, 16 during the printing of tablets, for instance. By way of example, the first marking engine 14 consumes toner in the course of generating a first print (or layer) on first print media (or edible substrate) 30, while the second marking engine 16 consumes toner in generating a second print (or layer) on print media (or edible substrate) 32, which may be the same or a different sheet of print media from print media 30. Each marking engine 14, 16 may receive fresh developer 34, 36 from a respective replaceable container (or sump) 38, 40, although it is also contemplated that the marking engines could be supplied toner from a common container.

With further reference to FIG. 3, each xerographic marking engine 14, 16 applies toner to print media 30, 32, such as sheets of paper, during the formation of images. The exemplary marking engines 14, 16 may include many of the hardware elements employed in the creation of desired images by electrophotographical (xerographical) processes. For example, the marking engines 14, 16 may utilize two component magnetic brush development systems, either to directly develop electrostatic images on a photoreceptor or to load a donor roll, which in turn is used to develop a photoreceptor. FIG. 1 illustrates an embodiment where images are developed directly on a photoreceptor.

Since both marking engines 14, 16 may be similarly configured, only one marking engine 14 will now be described, with similar elements on the other marking engine indicated by a prime (').  In particular, the marking engine 14 typically includes a charge retentive surface 80, such as a rotating photoreceptor in the form of a belt or drum. The images are created on a surface of the photoreceptor. Disposed at various points around the circumference of the photoreceptor 80 are xerographic components. The xerographic components each perform a portion of a marking operation (the formation of a layer of toner on the print media). These components may include a charging station 82 for each of the toners to be applied, such as a charging corotron, an exposure station 84, such as a raster output scanner (ROS), which forms a latent image on the photoreceptor, a developer unit 86, associated with each charging station for developing the latent image formed on the surface of the photoreceptor, a transferring unit 88, such as a transfer corotron, a fuser 90, for fusing the toner layers to the print media and a cleaning device 92, for cleaning the photoreceptor before a new toner layer is formed thereon. As will be appreciated, there may be multiple charging stations, exposure stations, and associated developer stations arranged around a single photoreceptor, one set for each toner. Alternatively, for each toner, a separate photoreceptor is provided. In this embodiment, the toner layers may be transferred from the photoreceptor to the sheet via an intermediate transfer belt. Alternatively, the photoreceptors are arranged in tandem, with the sheets being sequentially marked at a separate transfer station for each of the toners.

Optionally, a charging device, such as corotron, deposits charge through pre-determined masks to the receiving substrate (that can be photoreceptor or other semi-insulating media). These masks may be in the shape of tablets. In the case that a digital charging (such as ionographic writing) or exposure (such as ROS or LED), the API from each station can be deposited either layered on top of the previously deposited particles or can be put down adjacently. Depending on the API release timing, structures can be built around each API.

In operation, the photoreceptor 14 rotates and is charged at the charging station 82. The charged surface arrives at the exposure station 84, where a latent image is formed. The portion of the photoreceptor on which the latent image is formed arrives at the developer unit 86, which applies toner to the latent image to obtain a toner image. The developed image moves with the photoreceptor to the transferring unit 88, which transfers the toner image thus formed to the surface of the print media substrate 30 (or to an intermediate transfer belt), by applying a potential to the sheet. The sheet and image are conveyed away from the photoreceptor to the fuser 90, which fuses the toner image to the sheet using heat and/or pressure. Meanwhile, the photoreceptor 14 rotates to the cleaning device 92, which removes residual toner and charge from the photoreceptor, ready for beginning the process again. It is to be appreciated that the marking engine 14, 16 can include an input/output interface, a memory, a marking cartridge platform, a marking driver, a function switch, a controller and a self-diagnostic unit, all of which can be interconnected by a data/control bus.

By way of example, the first sump 38 may be configured to load a first toner, such as a single component, non-magnetic toner, onto the first donor roll 80. The first single component, non-magnetic toner may include a first API embedded or dissolved in the first toner and the first donor roll may be configured to transfer the first single component, non-magnetic toner to an edible substrate 30 to form a first layer on the edible substrate 30. The second sump 40 may be configured to load a second toner, such as a single component, non-magnetic toner, onto the second donor roll 80'. The second single component, non-magnetic toner may include a second API embedded or dissolved in the second toner and the second donor roll may be configured to transfer the second single component, non-magnetic toner to the edible substrate 30 to form a second layer on the edible substrate 30. The developers 86, 86' may be configured to develop the layers of toner on the edible substrate 30 and, optionally, a depositor (not shown) may be configured to deposit one or more protective overcoat materials on the layers of toner to finalize the medication.

Figure 4:
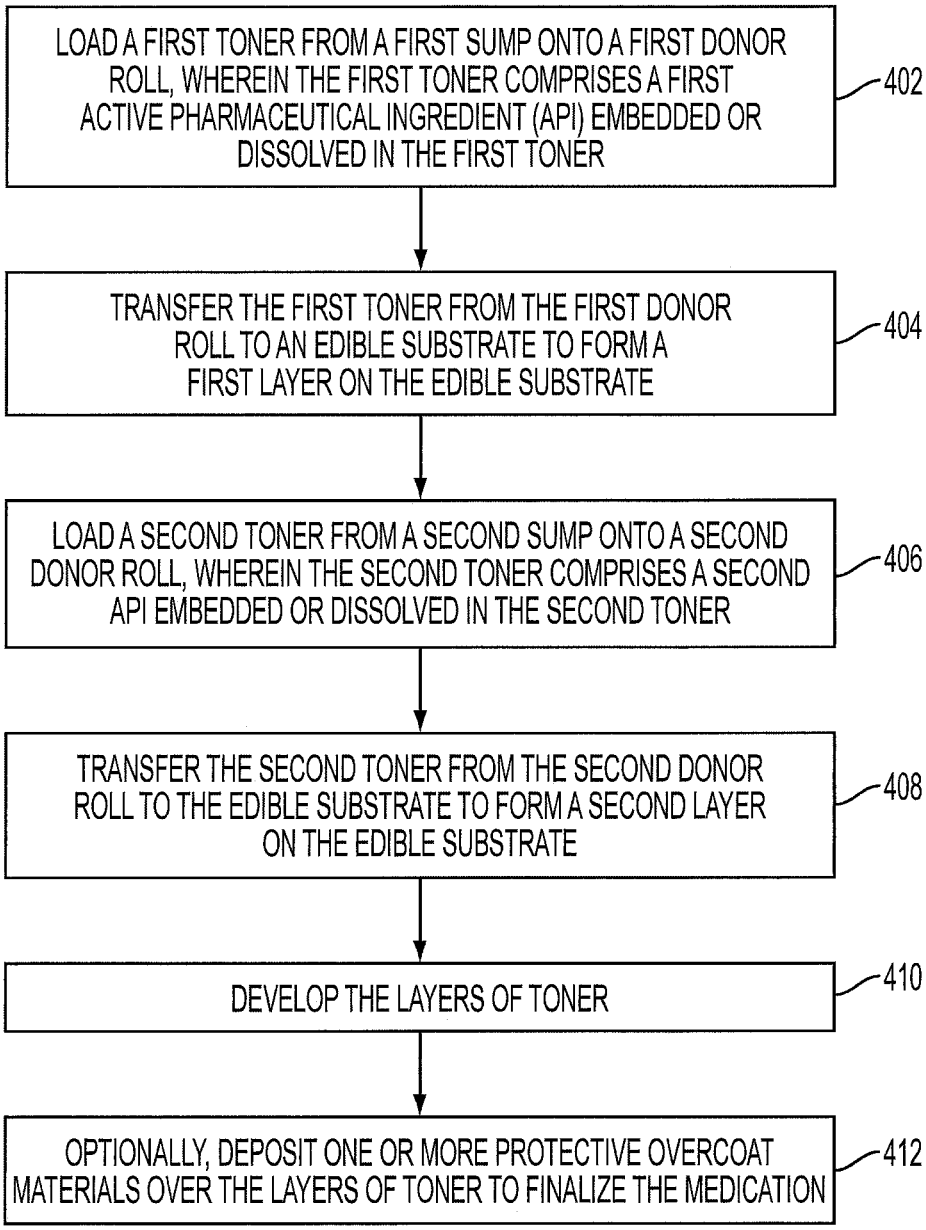
FIG. 4 is a flow chart illustrating an exemplary method of printing personalized medication on edible substrates.

An exemplary computer-implemented method of printing personalized medication using the printing system of FIG. 3 is shown in FIG. 4. The exemplary method generally includes loading, for example, a first toner 34, such as a single component, non-magnetic toner, from a first sump 38 onto a first donor roll 80 (402). Typically, the first single component, non-magnetic toner 34 includes a first type of API embedded or dissolved in the toner 34. The first single component, non-magnetic toner 34 is then transferred from the first donor roll 80 to an edible substrate 30 to form a first layer on the edible substrate 30 (404). A second toner 36, such as a single component, non-magnetic toner, is then loaded from a second sump 40 onto a second donor roll 80' (406). The second single component, non-magnetic toner 36 generally includes a second type of API embedded or dissolved in the second toner 36. The second single component, non-magnetic toner 36 from the second donor roll 80' is transferred to the edible substrate 30 to form a second layer on the edible substrate (408). The layers of toner are developed via a developer 86, 86' (410), and, optionally, one or more protective overcoat materials are deposited over the layers of toner to finalize the medication (412).

The exemplary methods described herein may be implemented in a non-transitory computer program product that may be executed on a computer or other type of computing device. The computer program product may be a tangible computer-readable recording medium (or computer-usable data carrier) on which a control program is recorded, such as a disk, hard drive, or may be a transmittable carrier wave in which the control program is embodied as a data signal. Common forms of computer-readable media (or data carriers) include, for example, flash drives, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, transmission media, such as acoustic or light waves, such as those generated during radio wave and infrared data communications, and the like, or any other medium from which a computer can read and use.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method of printing personalized medication with a printing system, the method comprising:

dissolving at least a salicylate material in binder, to create a first triboelectrically chargeable medicament toner, wherein one or more pharmaceutically inert ingredients are compounded in the binder in addition to the salicylate material;

transferring the charged toner to a selectively exposed intermediate member;

transferring the toner from the intermediate member to an edible substrate;

fusing the transferred toner via cold pressure, warm pressure, or radiant fusing;

compounding another material in binder, to create a second triboelectrically chargeable medicament toner different from the first toner;

transferring the second charged toner to a second selectively exposed intermediate member;

transferring the second toner from the intermediate member to form a second layer on the edible substrate;

fusing the second transferred toner via cold pressure, warm pressure, or radiant fusing; and depositing one or more protective overcoat materials to finalize the personalized medication, wherein the printing system includes multiple transfer stations configured to deliver either increased doses or tablets with more than one triboelectrically chargeable medicament toner.

2. The method of claim 1, wherein the intermediate member comprises a donor roll or a web.

3. The method of claim 1, wherein at least one of the first and second toners comprises a single component toner.

4. The method of claim 1, wherein at least one of the first and second toners comprises a two-component toner and includes a carrier.

5. The method of claim 1, wherein at least one of the first and second toners comprises a single component, non-magnetic toner.

6. The method of claim 1, wherein the multiple transfer stations are further configured to deliver tablets with more than one salicylate material.

7. A method of printing personalized medication with a printing system, the method comprising:

compounding a salicylate material in binder, to create at least one triboelectrically chargeable medicament toner, wherein one or more pharmaceutically inert ingredients are compounded in the binder in addition to the salicylate material;

directly depositing the medicament toner onto an edible substrate;

fusing the transferred toner via cold pressure, warm pressure, or radiant fusing; and further comprising compounding another material in binder, to create a second triboelectrically chargeable medicament toner different from the first toner; directly depositing the second medicament toner onto the edible substrate to form a second layer on the edible substrate; and fusing the second transferred toner via cold pressure, warm pressure, or radiant fusing and depositing one or more protective overcoat materials to finalize the personalized medication, wherein the printing system includes multiple transfer stations configured to deliver increased doses.

8. The method of claim 7, wherein the toner comprises a single component toner.

9. The method of claim 7, wherein the toner comprises a two-component toner and includes a carrier.

10. The method of claim 7, wherein the toner comprises a single component, non-magnetic toner.

11. A method of printing personalized medication, the method comprising:

loading a first single component, non-magnetic toner from a first sump onto a first donor roll, wherein the first toner comprises a first salicylate material embedded or dissolved in at least one toner binder, wherein one or more pharmaceutically inert ingredients are compounded in the binder in addition to the salicylate material;

transferring the first toner from the first donor roll to an edible substrate to form a first layer on the edible substrate;

loading a second single component, non-magnetic toner from a second sump onto a second donor roll, wherein the second toner comprises a second salicylate material embedded or dissolved in at least one toner binder and is different from the first toner;

transferring the second toner from the second donor roll to the edible substrate to form a second layer on the edible substrate and an increased dose;

developing the layers of toner; and depositing one or more protective overcoat materials over the layers of toner to finalize the personalized medication, wherein the printing system includes multiple transfer stations configured to deliver increased doses.

12. The method of claim 11, wherein each printed layer undergoes cold pressure fusing, warm pressure fusing, or radiant fusing.

13. A method of printing personalized medication with a printing system, the method comprising:

dissolving an active pharmaceutical ingredient (API) in binder, to create at least one triboelectrically chargeable medicament toner, wherein one or more pharmaceutically inert ingredients are compounded in the binder in addition to the API;

transferring the charged toner to a selectively exposed intermediate member;

transferring the toner from the intermediate member to an edible substrate;

fusing the transferred toner via cold pressure, warm pressure, or radiant fusing;

compounding another API in binder, to create a second triboelectrically chargeable medicament toner different from the first toner;

transferring the second charged toner to a second selectively exposed intermediate member;

transferring the second toner from the intermediate member to form a second layer on the edible substrate; and fusing the second transferred toner via cold pressure, warm pressure, or radiant fusing; and depositing one or more protective overcoat materials to finalize the personalized medication, wherein the printing system includes multiple transfer stations to deliver increased doses or tablets with more than one API.

14. The method of claim 13, wherein the intermediate member comprises a donor roll or a web.

15. The method of claim 14, wherein the first and second toners comprise one or more of a single component toner, a two-component toners including at least one carrier, or a single component, non-magnetic toner.

* * * * *